US006975216B2

(12) United States Patent
Tharman et al.

(10) Patent No.: US 6,975,216 B2
(45) Date of Patent: Dec. 13, 2005

(54) SYSTEM AND METHOD FOR INDICATING FLUID CONDITION

(75) Inventors: Paul A. Tharman, Pewaukee, WI (US); David G. DeBaets, Auburn, AL (US); Steven G. Hoch, Slinger, WI (US); Jeffrey C. Blonski, Racine, WI (US); Robert L. Blohm, Hubertus, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 297 days.

(21) Appl. No.: 10/454,267

(22) Filed: Jun. 4, 2003

(65) Prior Publication Data

US 2004/0246118 A1 Dec. 9, 2004

(51) Int. Cl.[7] ..... B60Q 1/00; G08B 21/00

(52) U.S. Cl. ..... 340/438; 340/441; 340/450.1; 340/450.2; 340/450.3; 340/618; 340/620; 73/290 R; 73/291; 73/304 R

(58) Field of Search ..... 340/438, 441, 340/450.1, 450.2, 450.3, 618, 620; 73/290 R, 291, 304 R

(56) References Cited

U.S. PATENT DOCUMENTS

| | | | | |
|---|---|---|---|---|
| 3,631,388 A | | 12/1971 | Strong | |
| 3,846,747 A | | 11/1974 | Arai et al. | |
| 3,886,517 A | | 5/1975 | Ohtake et al. | |
| 3,906,440 A | | 9/1975 | Haupt | |
| 3,938,117 A | | 2/1976 | Bozoian | |
| 3,939,470 A | | 2/1976 | Arai et al. | |
| 4,107,658 A | | 8/1978 | Hill et al. | |
| 4,367,462 A | | 1/1983 | Dressler | |
| 4,385,290 A | | 5/1983 | Fiala | |
| 4,503,419 A | | 3/1985 | Kidd et al. | |
| 4,539,547 A | | 9/1985 | Nagy, Jr. et al. | |
| 4,584,554 A | | 4/1986 | Weiss | |
| 4,684,917 A | | 8/1987 | Tharman | |
| 4,734,682 A | * | 3/1988 | Bond, Jr. | 340/614 |
| 4,845,469 A | | 7/1989 | Benda | |
| 4,859,987 A | | 8/1989 | Markus | |
| 4,984,543 A | | 1/1991 | Tharman | |
| 4,995,357 A | | 2/1991 | Gonnering et al. | |
| 5,053,745 A | | 10/1991 | Sasaki et al. | |
| 5,107,248 A | | 4/1992 | Koiwa et al. | |
| 5,388,553 A | * | 2/1995 | Burke et al. | 123/179.8 |
| 6,040,767 A | | 3/2000 | Dykstra | |
| 6,239,709 B1 | | 5/2001 | Dykstra et al. | |

* cited by examiner

*Primary Examiner*—Jeffery Hofsass
*Assistant Examiner*—Lam Pham
(74) *Attorney, Agent, or Firm*—Michael Best & Friedrich LLP

(57) ABSTRACT

A fluid condition indicating system and method using visual and audible devices. The system includes a circuit having visual and audible indicators, a power supply, and a plurality of switches or sensors. A start switch is coupled to the power supply, the visual indicator, and the audible indicator, and an enable switch is responsive to an ignition signal. During engine starting, the circuit enables the visual indicator in response to a condition of the start switch and a low fluid sensor, and disables the audible indicator. The audible indicator is enabled in response to the condition of the enable switch after engine starting, and may include a transistor or an output of a controller such as a microprocessor. The system may be integrated into a single wiring harness that can be easily replaced or retrofit onto existing outdoor power equipment.

26 Claims, 6 Drawing Sheets

SYSTEM AND METHOD FOR INDICATING FLUID CONDITION

BACKGROUND OF THE INVENTION

The invention generally relates to indicating fluid levels in an internal combustion engine. More particularly, the invention relates alerting an operator of a low lubricating fluid level, such as oil, by visual and audible devices.

A variety of systems exist for indicating a low fluid level or condition. Some systems employ an indicator light that turns on when an engine oil level or pressure drops below a predetermined value. In other systems, an audible alarm may be implemented such that the operator will hear the alarm upon attempting to start the engine. However, in some situations an initial oil pressure, which increases to an acceptable value after starting, may be determined low and thus the audible alarm is activated in error. In addition, audible alarms typically have a large audible magnitude and may confuse the operator during starting.

SUMMARY OF THE INVENTION

Disclosed is an improved system and method for indicating the existence of a low fluid level to an operator. In one embodiment, the system includes a circuit that enables a visual indicator and disables an audible indicator during engine starting and in response to the condition of an oil level or oil pressure switch.

In another embodiment of the invention, a circuit generally includes or is coupled to a visual indicator, an audible indicator, a power supply, a start switch, a low fluid sensor, and an enable switch. The start switch may be coupled to the power supply, the visual indicator, and the audible indicator, and the enable switch is responsive to an ignition signal. The ignition signal may be provided from a magnet moving past a coil and conditioned by a filter, such as a capacitor. The power supply powers the visual indicator in response to a condition of the start switch and the low fluid sensor, and powers the audible indicator in response to the condition of the start switch, the low fluid sensor, and a condition of the enable switch. The power supply may include a battery, capacitor, or a magnet moving past a coil. The condition of the enable switch may be controlled by the ignition signal and changed in response to engine speed during starting. In other embodiments, a subset of components associated with the circuit may be integrated into a wiring harness.

Additional embodiments of the invention include a method of indicating a low fluid condition in an engine. The method generally includes changing a condition of a low fluid sensor in response to a low fluid condition and enabling a visual indicator during engine starting in response to a start switch and the condition of a low fluid sensor. The audible indicator is disabled prior to and during engine starting. The audible indicator activates once the engine has started and in response to the condition of the low fluid sensor. The visual indicator may be enabled by providing a current path from a power source, through the visual indicator, to ground when a low fluid condition exists and the start switch is activated. Disabling the audible indicator includes delaying the activation of an enable switch. The enable switch may include a transistor or an output of a controller such as a microprocessor.

DETAILED DESCRIPTION OF THE INVENTION

Figure 1:
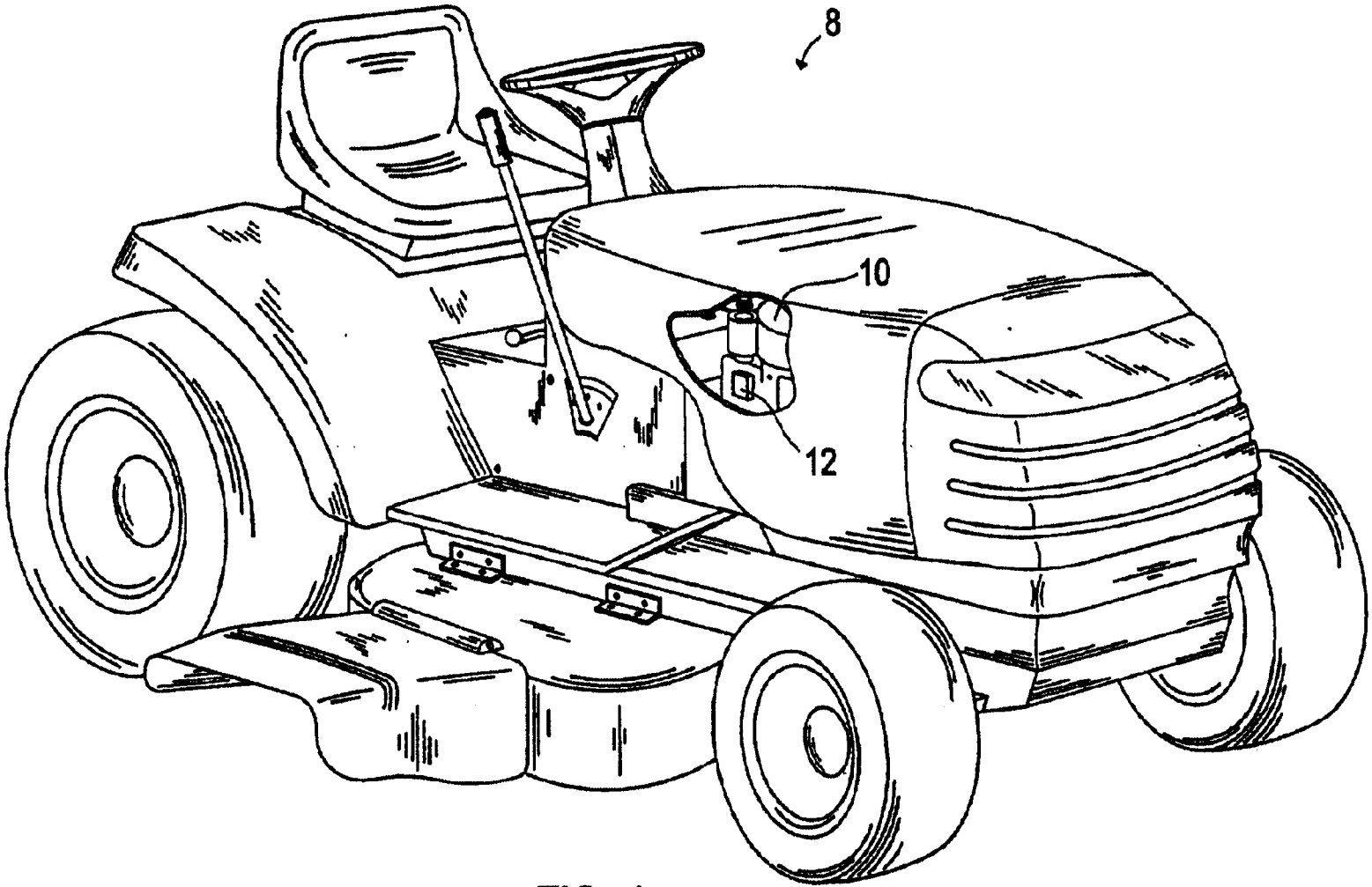
FIG. 1 illustrates an exemplary lawn and garden vehicle according to one embodiment of the invention.

Before embodiments of the invention are explained in detail, it is to be understood that the invention is not limited in its application to the details of the examples set forth in the following description or illustrated in the drawings. The invention is capable of other embodiments and of being practiced or carried out in a variety of applications and in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting, and coupling. Further, "connected" and "coupled" are not restricted to physical or mechanical connections or couplings.

It should also be understood that some components and items are illustrated and described as if they were hardware elements, as is common practice within the art. However, one of ordinary skill in the art, and based on a reading of this detailed description, would understand that, in at least one embodiment, components of the invention may be implemented in software, hardware, or a combination thereof.

Referring now to FIG. 1, the principles of the invention are illustrated as being applied to a magneto-ignition system included in tractors, such as lawnmower 8, having a single or multiple cylinder internal combustion engine that contains oil or another lubricant. However, the invention may be implemented with other types of ignition systems of the type used for powering pumps, electrical generators, snow blowers, and the like. It should be noted that the illustrated lawnmower 8 is merely exemplary and that the invention may also be implemented with a variety of farming or other commercial tractors.

The lawnmower 8 of FIG. 1 includes an engine 10 and a magneto-ignition system. The magneto-ignition system includes a primary winding circuit 12 having a coil with a relatively small number of turns of relatively coarse wire, and a secondary winding circuit (not shown) having a coil with numerous turns of relatively fine wire. The primary and secondary coils are inductively coupled with one another in a conventional manner by means of a ferromagnetic core (not shown) on which they are both wound. A spark plug (not shown) is connected across the terminals of the secondary winding. Although the invention is illustrated as being applied to a single cylinder internal combustion engine having only one spark plug, the invention may be used with engines having a plurality of spark plugs connected with the secondary coil in a known manner by means of a conventional distributor or electronic control unit used with multi-cylinder engines. In the case of a breakerless magneto-ignition system, the operation of the magneto requires that a circuit between the terminals of the primary winding circuit 12 be closed and opened by switching means operated in properly timed relation to the engine cycle. For example, the primary coil may cooperate with a permanent magnet assembly carried for orbital motion on a flywheel mounted on the engine crankshaft. The crankshaft rotates in timed relation to the engine cycle and the permanent magnet induces an ignition pulse in the primary coil corresponding to the crankshaft timing.

Figure 2:
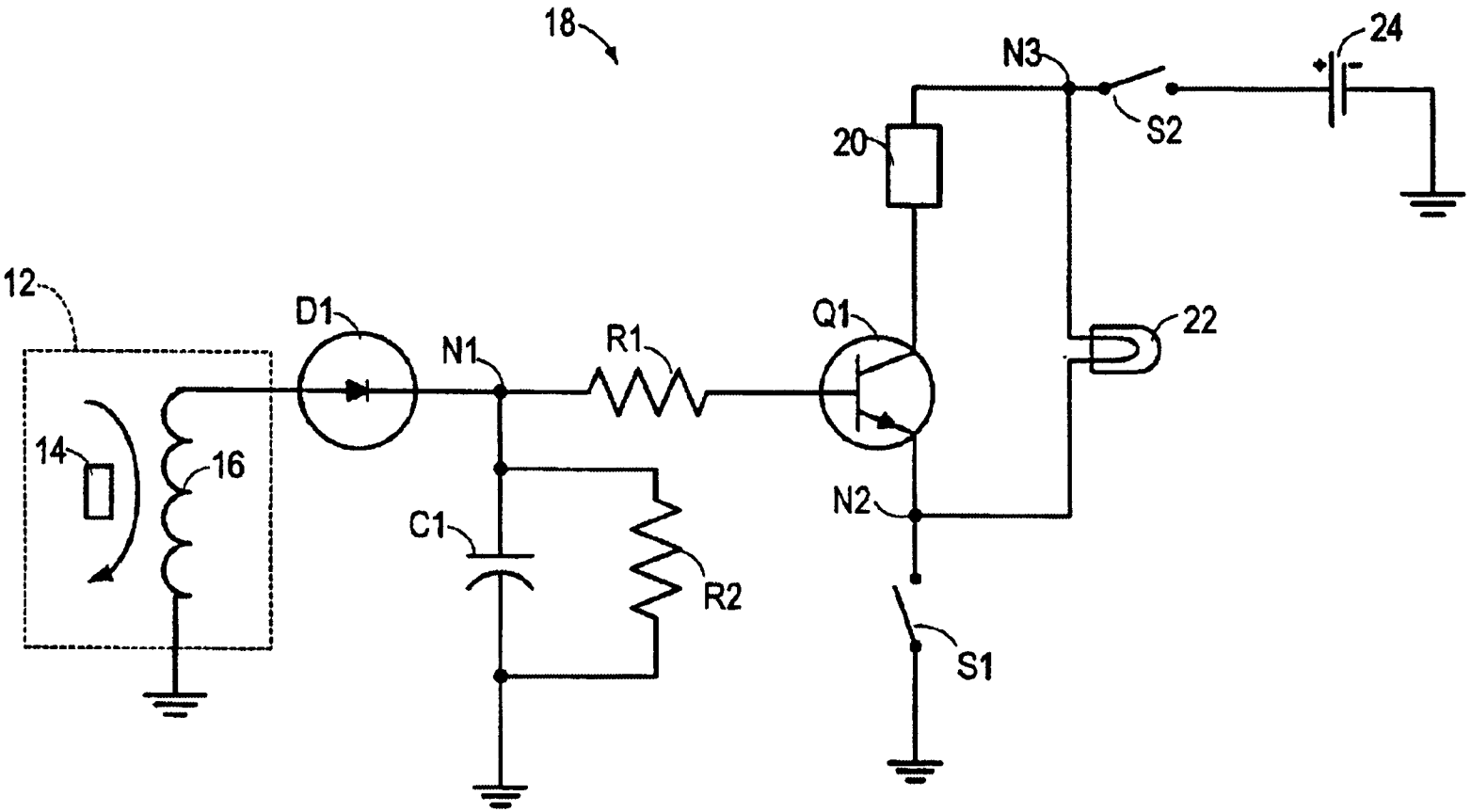
FIG. 2 illustrates an exemplary circuit according to one embodiment of the invention.

FIG. 2 illustrates an indicating circuit 18 corresponding to one embodiment of the invention. The indicating circuit 18 is shown coupled to a portion of an ignition circuit, such as the primary winding circuit 12, represented by a magnet 14 and a coil 16. The magnet 14 and coil 16 generally comprise an ignition signal source. An output of the coil 16 (e.g., a pulse signal from the primary winding circuit 12) is coupled to the anode terminal of a diode D1. The cathode terminal of the diode D1 is coupled, at node N1, to one terminal of a resistor R1, a resistor R2, and a capacitor C1. The diode D1 allows current to flow from the coil 16 to node N1, when in a forward biased state, but limits current flow in the reverse direction. The capacitor C1 and resistor R2 each connect to a common potential, such as a ground potential or simply "ground," and thus form a parallel current path from node N1 to ground. The resistor R1 connects from node N1 to node N4 and, therefore to a capacitor C2 and the cathode terminal of a diode Z1. The capacitor C2 is connected to ground and the anode terminal of diode Z1 is connected to the base terminal of an enable switch, such as a transistor Q1 or microprocessor (described below). It should be noted that a variety of transistors may be used with the invention including field effect transistors ("FETs"), bipolar junction transistors ("BJTs"), or the like. In addition, a Darlington or other multiple transistor configurations may be used with the invention. In one embodiment, the capacitor C2 aids in reducing the voltage fluctuations, or "ripple," that may be inherent in the ignition signal. In addition, the diode Z1 is configured to operate in voltage breakdown region, such as a common zener diode, and prevents activation of the transistor Q1 until the voltage across the cathode to anode terminal of diode Z1 is sufficient. Thereafter, current flows through diode Z1 and enables the transistor Q1. This aids in preventing intermittent activation of the transistor Q1 and thus the audible indicator 20 when the engine is cranking. It should be noted that the diode Z1 and capacitor C2 are not required to implement the invention.

Referring back to FIG. 2, the exemplary transistor Q1 is shown in common emitter configuration with an emitter terminal coupled to a node N2. The collector terminal of the transistor Q1 is connected to an audible indicator 20, which may include various types of buzzers and alarms. The audible indicator 20 is also connected to a node N3. A visual indicator 22 is coupled to the circuit 18 between node N2 and node N3. A fluid sensor or switch S1 couples node N2 to ground. The fluid switch S1 may be a fluid level or fluid pressure sensor that is maintained between an active and non-active condition. For example, if the fluid level or pressure associated with the engine 10 is acceptable, the fluid switch S1 is in an off or "open" condition, as illustrated in FIG. 2. If the fluid level or pressure is below an acceptable value (i.e., "low"), then the fluid switch S1 may be changed to an on or "closed" condition.

A start switch S2 is connected between a power supply, such as a battery 24, and node N3. The start switch S2 represents a variety of possible engine starting procedures including inserting a key and rotating an ignition switch, activating a pushbutton or toggle switch, actuating a safety lever, or the like. In general, the start switch S2 may be any device or action that provides a closed and open condition where the battery 24 is respectively coupled and decoupled from the circuit 18 and the engine.

As one exemplary discussion of operation, a user may wish to start the engine 10 and thus actuate the start switch S2. In doing so, the battery 24 is coupled to node N3, thereby making power available to other components of the circuit 18. Specifically, the visual indicator 22 coupled between node N2 and N3 is enabled or energized depending on the condition of the fluid switch S1. If the fluid level or pressure is within an acceptable range, the switch S1 remains open and the visual indicator 22 remains off. If the fluid level or pressure is reduced such that the switch S1 is closed, a current path is established from the battery, through the visual indicator 22, to ground and the visual indicator is enabled, or turned ON. However, the current path from node N3 to node N2 via the audible indicator does not exist because the enable switch, transistor Q1, remains in an OFF or inactive condition. The transistor Q1 does not provide a current path from the collector to the emitter (and then to ground) unless it is biased to an active mode (e.g., the base-emitter voltage is sufficient). Therefore, when the start switch S2 is closed during starting and there exists a condition of a low fluid level or low fluid pressure, the circuit 18 allows the visual indicator 22 to energize and prevents the audible indicator 20 from energizing. If the operator does not notice or ignores the visual indicator 22, and continues to start the engine, the circuit 18 will then enable the audible indicator 22 after the engine has started. In the embodiment illustrated in FIG. 2, the audible indicator 22 is enabled using a signal from the coil 16.

As noted above, the output of the coil 16 may be a pulse, or pulse train, that increases in frequency as crankshaft rotation increases. The signal output from the coil 16 charges the capacitor C1 at a rate corresponding to a time constant (i.e., R2 ohms×C1 farads=π seconds). The capacitor charges and discharges at a finite rate in response to each pulse. During engine starting, the pulse frequency is not sufficient to charge the capacitor C1 to a level that biases the transistor Q1 into an active state. Some time later, the engine speed increases to where the output of the coil 16 is sufficient to maintain a charge in the capacitor C1 that activates the transistor Q1. Thus, if the fluid switch S1 remains in a closed position, transistor Q1 allows current to flow from the battery 24 through the audible indicator 20 to ground, thereby enabling or activating the audible indicator 20. In this manner, an operator that does not see the visual indicator 22 during engine starting is alerted a second time with the audible indicator 20. The operator will then know to shut off the engine and attend to the problem.

Figure 3:
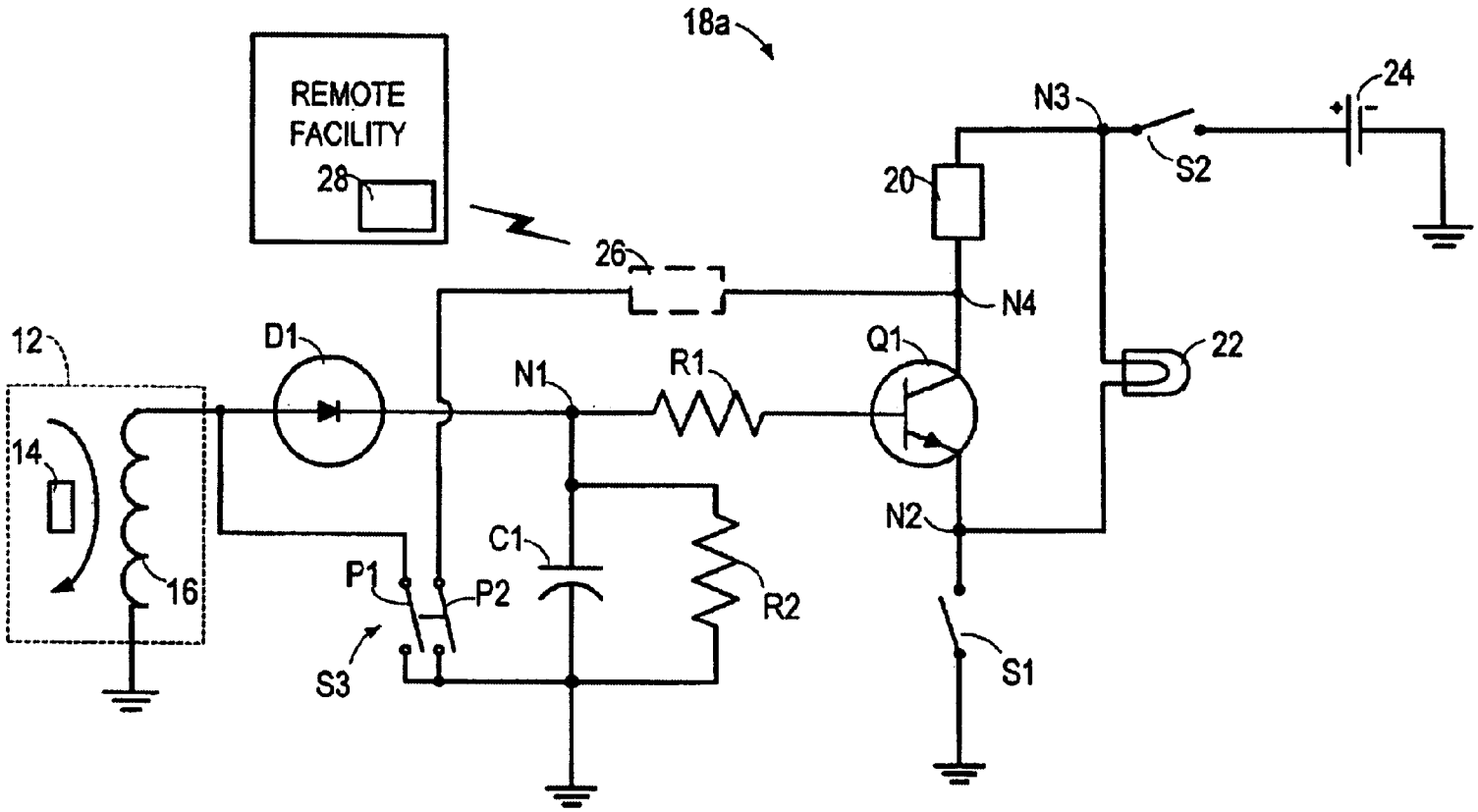
FIG. 3 illustrates an exemplary circuit including a panic switch according to another embodiment of the invention.

As illustrated in FIG. 3, another embodiment of the invention includes an emergency or panic switch S3 coupled to the circuit 18. One exemplary switch for use in this embodiment is a double-pole single-throw contact switch, although others may be used. Pole P1 of the panic switch S3 has one terminal connected to the coil 16 and the other terminal connected to ground. Pole P2 of the panic switch S3 has one terminal connected at node N4, which is between the audible indicator 20 and the transistor Q1. The other terminal of pole P2 is also connected to ground. In operation, the panic switch S3 may be used for situations where a user wishes to quickly stop the engine 10 of the lawnmower 8 (FIG. 1). Such situations may include a sudden medical condition, an obstacle, or another situation where the operator desires to stop the lawnmower 8 quickly and draw attention to themselves (such as the case of a sudden medical condition). The panic switch S3 may be located on the lawnmower 8 in a position convenient for manual actuation by the operator, such as on an instrument panel.

Actuation of the panic switch S3 closes pole P1 and pole P2, and creates a current path from both the coil 16 and node N4 to ground. Connecting the output of the coil 16 to ground prevents additional ignition signals from reaching the spark plug(s), which causes the engine to shut off. The current path from node N4 to ground allows the battery 24 to power the audible indicator 20 (when the switch S2 is in a closed position). The audible indicator 20 is preferably loud enough for an operator to hear over the sound created by a running engine and, when the engine is shut off, draws the attention of people besides the operator.

In other embodiments, the panic switch S3 may be implemented to activate a transmitter 26 which signals a receiver located remote from the operator (e.g., in the operator's house or at a medical care facility). The transmitter 26 may include a variety of commercially available radio-frequency, or other type, transmitters. When the panic switch S3 is activated, the battery 24 powers the audible indicator 20 (as described above) and the transmitter 26, which sends a signal to the receiver 28 indicating an emergency situation. The receiver 28, in response to the signal, may be used in conjunction with alarms, displays, or the like to notify others of the situation.

Figure 4:
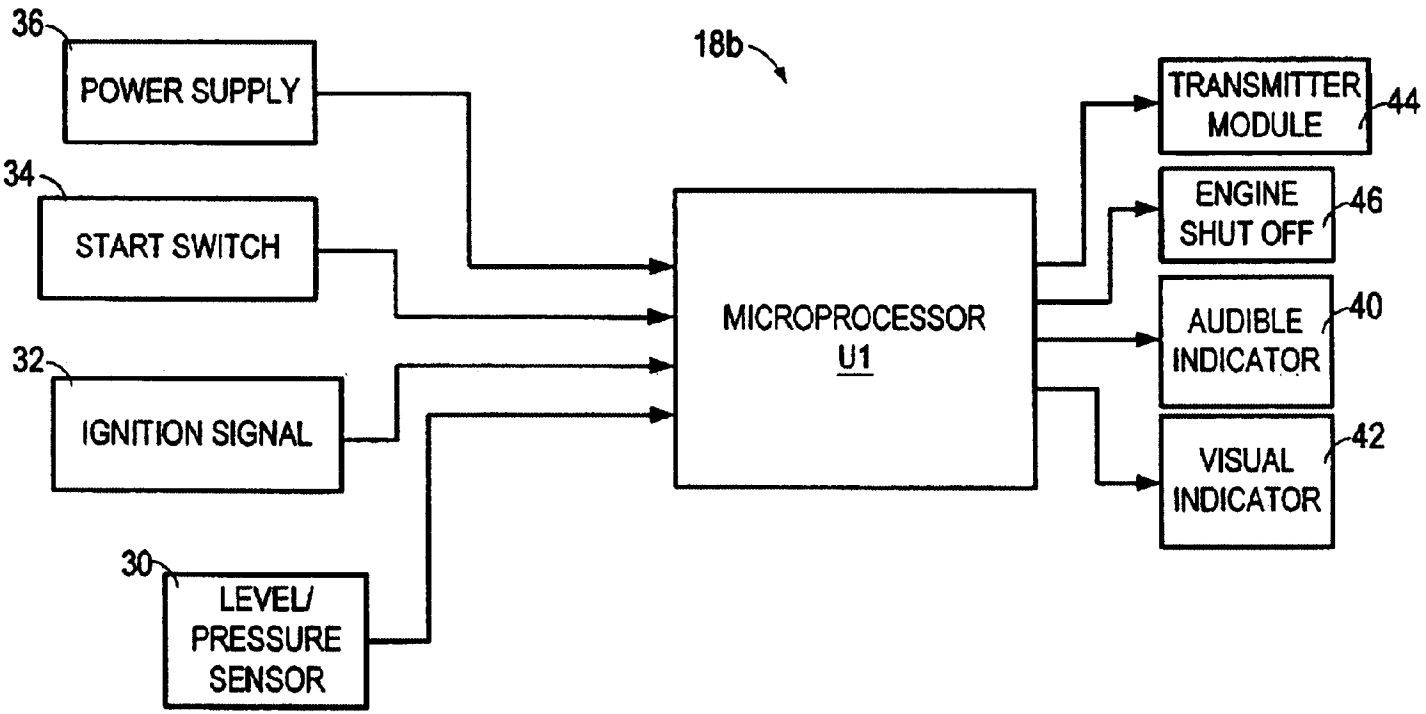
FIG. 4 illustrates an exemplary microprocessor based circuit according to yet another embodiment of the invention.

It should be noted that the invention is not limited in implementation to the above described circuit configuration and that other additional circuit components may be utilized. For example, FIG. 4 illustrates an embodiment of the invention where an indicating circuit 18*c* is implemented with a microprocessor U1 having inputs to receive information from a fluid level/pressure sensor 30, an ignition primary 32, a start switch 34, and a power supply 36. One or more outputs of the microprocessor U1 may be used to control an audible indicator 40, a visual indicator 42, a transmitter module 44, and to shut off the engine (shown graphically at block 46). The microprocessor U1 may be programmed using a variety of software tools to implement the functionality associated with the above-described embodiments. For example, the microprocessor U1 may activate the visual indicator 42 in response to a signal from the start switch 34 and a condition of the fluid level/pressure sensor 30, and delay the activation of the audible indicator 40 until a signal from the ignition primary 32, corresponding to engine starting, is received. The microprocessor U1 may include various timers or other components operable to delay the activation of the audible indicator 40.

In other embodiments, some or all of the components comprised in the indicating circuit 18, 18*a*, 18*b* may be integrated with an electrical connector assembly or wiring harness, such as a harness by an original equipment manufacturer ("OEM") or as a separate harness operable to retrofit an engine or existing outdoor power equipment. The OEM harness is a wiring harness that provides power to electrical devices of outdoor power equipment, such as lawnmower 8.

Figure 5:
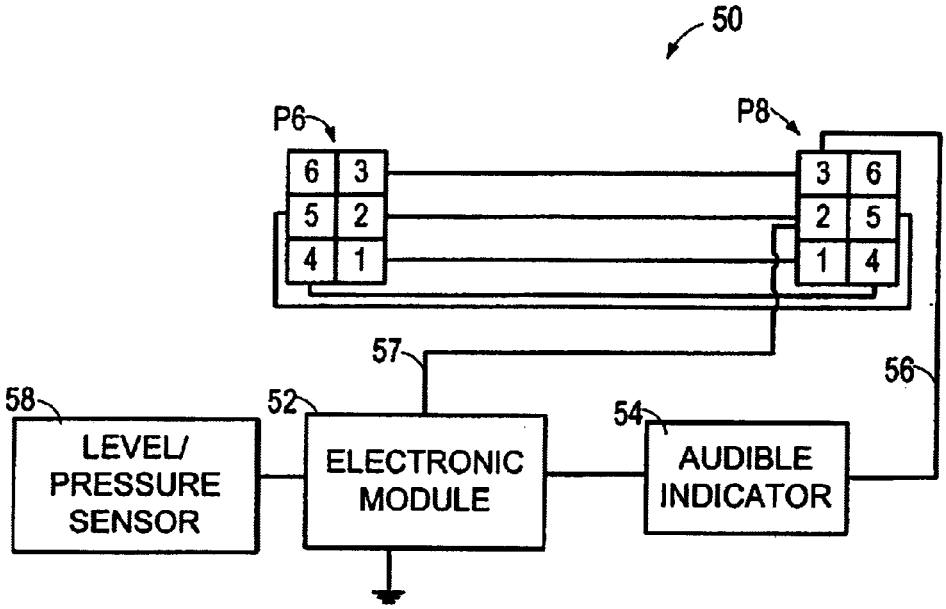
FIG. 5 illustrates an exemplary wiring harness configuration according to one embodiment of the invention.

FIG. 5 illustrates an exemplary harness 50 having input and output connectors, plugs P6 and P8 respectively, configured for a standard 6-pin connection. The plugs P6 and P8 may be connected in series with or replace an OEM 6-pin engine wiring harness. As one example, plug P6 is received by an engine harness (not shown) and plug P8 is received by an OEM harness (not shown). It will be understood that the connections to the OEM harness and factory engine harness may be provided by conventional male/female plug components or other terminal connectors or fasteners suitable for electrical connections.

Figure 6:
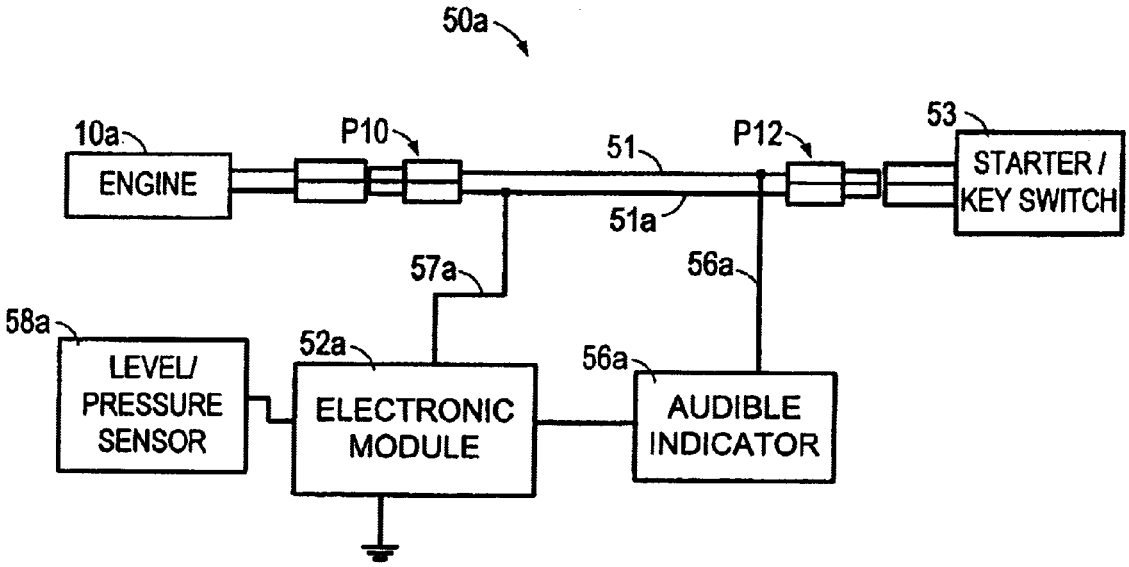
FIG. 6 illustrates an exemplary wiring harness configuration according to another embodiment of the invention.

In addition, FIG. 6 illustrates another exemplary harness 50*a* including input and output connectors, plugs P10 and P12 respectively, that may be configured with engine harnesses that are not based on a standard pin or plug configuration. The connectors P10 and P12 may include conventional male/female plug components or other fasteners suitable for electrical connections. The exemplary two-wire harness 50*a* is connected to an engine 10*a* and a start/key switch 53. In one embodiment, line 51 of the harness 50*a* is connected to a fuel solenoid associated with the engine 10*a* and line 51*a* is connected to an ignition system, such as a starter motor of the engine 10*a*. The fuel solenoid is operable to control the flow of fuel to the engine combustion chamber. The start/key switch 53 is electrically connected to the fuel solenoid so that fuel flow into the combustion chamber is stopped when the engine is shut off. During engine starting, a signal from the start/key switch 53 enables the fuel solenoid, thereby allowing fuel to flow to the combustion chamber. The audible indicator 56*a* is also connected to line 51 via line 56*a*, and an electronic module 52*a* is connected to line 51*a* via line 57*a*. A level/pressure sensor 58*a* is coupled to the electronic module 52*a*.

As one example, an OEM harness is disconnected from an engine, such as the engine 10, 10*a*. The harness 50, 50*a* is then connected in series so that an integrated controller, such as electronic module 52, 52*a*, is operable to enable the audible indicator 54, 54*a* while maintaining the previous electrical connections to factory systems, such as lights, gauges, and the like. The audible indicator 54, 54*a* receives power from line 56, 56*a*, which may represent electrical connection to a terminal of the start/key switch 53 operable to control the power to a fuel solenoid, as described above. In addition, the electronic module 52, 52*a* is connected via line 57, 57*a* to a terminal on line 51*a* associated with an ignition signal. During starting, the start/key switch 53, which may be similar to start switch S2 in FIG. 2, is actuated such that power is available at line 56, 56*a*, and therefore to the audible indicator 54, 54*a*. In response to the condition of the level/pressure sensor 58, 58*a*, the electronic module 52, 52*a*, enabled by the ignition signal, actuates the audible indicator 54, 54*a* thereby notifying the operator of the engine condition. As noted above, a subset of components of the indication circuit 18, 18*a*, 18*b*, as illustrated in conjunction with FIGS. 2, 3, and 4, may be comprised in the electronic module 52, 52*a*.

Figure 7:
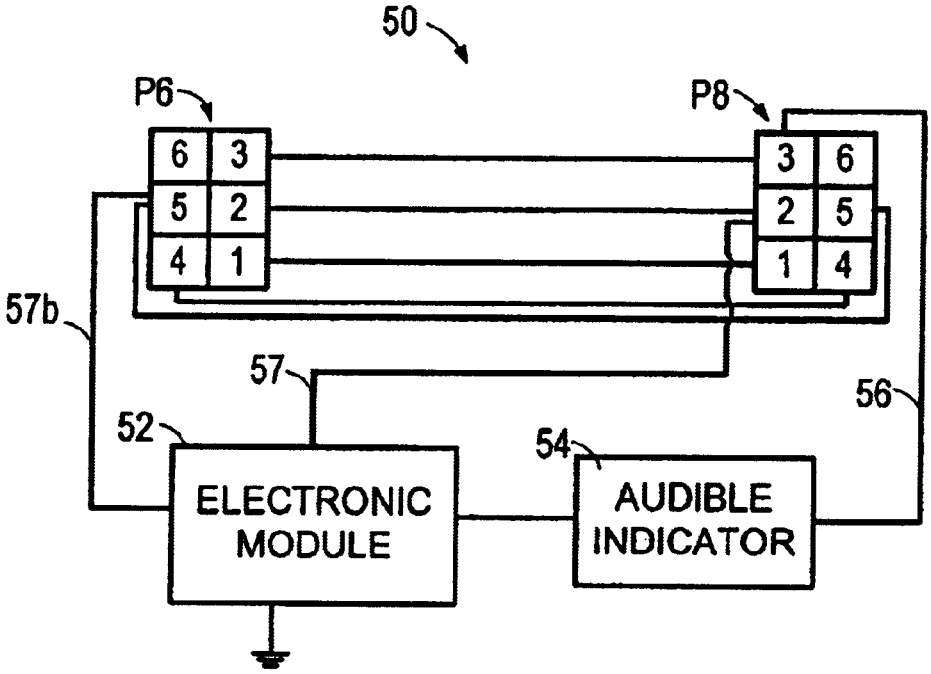
FIG. 7 illustrates another wiring harness configuration according to the invention.

Further, FIG. 7 illustrates another configuration of the harness 50 where a level/pressure sensor is integrated with an engine and an output of the sensor is provided with the engine harness operable to receive plug P6. The electronic module 52 is therefore provided with a connection (line 57*b*) to pin 5 of plug P6 indicating that the level/pressure signal may be received or extracted from an existing or otherwise integrated sensor.

Accordingly, an engine may be retrofit with an indicating circuit without needing a mounting bracket for the audible indicator or controller. Further, these types of serial and modular connections provide for ease of servicing and component replacement. A service technician may replace the indicating circuit by simply detaching the harness 50, 50*a* and replacing it with a new one.

As described above, one embodiment of the invention provides a method and system for alerting an operator of a low lubricating fluid level, such as oil, by visual and audible devices. Various features and aspects of the invention are set forth in the following claims.

What is claimed is:

1. A system that indicates a low fluid condition during starting of an engine, the engine having an ignition coil, the system comprising:

a visual indicator;

an audible indicator;

a start switch; and a low fluid sensor responsive to a low fluid condition;

wherein the visual indicator, audible indicator, start switch, and low fluid sensor are connected in a circuit that both enables the visual indicator and disables the audible indicator when the low fluid sensor indicates that a low fluid condition exists during engine starting.

2. The system of claim 1, wherein the circuit further comprises a controller.

3. The system of claim 2, wherein the controller includes one or more inputs to receive information based on the condition of the start switch, the low fluid sensor, and the engine.

4. The system of claim 2, wherein the controller is operable to enable the audible indicator in response to a signal received from the low fluid sensor after the engine has started.

5. The system of claim 2, wherein the audible indicator and controller are integrated into a wiring harness, the wiring harness being electrically connectable with the engine.

6. The system of claim 5, wherein the wiring harness is adapted to be serially connected between an engine electrical wiring harness and a wiring harness that provides power to an electrical device of outdoor power equipment.

7. The system of claim 5, wherein the wiring harness includes an input connector comprising a 6-pin plug, and an output connector comprising a 6-pin plug.

8. The system of claim 1, further comprising a power supply.

9. The system of claim 8, wherein the power supply includes a battery that powers at least one of the visual indicator and audible indicator.

10. The system of claim 8, wherein the power supply includes a capacitor.

11. The system of claim 8, wherein the power supply is operable to provide power to the audible indicator and visual indicator.

12. The system of claim 8, wherein the power supply includes a magnet moving past a coil.

13. The system of claim 12, wherein the magnet moving past the coil provides power to at least one of the visual indicator and the audible indicator.

14. The system of claim 1, further comprising:

a battery that powers the visual indicator;

a magnet moving past a coil to provide an ignition signal;

a signal conditioner that conditions the ignition signal to generate a conditioned signal; and an enable switch that receives the conditioned signal and that enables the audible indicator.

15. The system of claim 1, wherein the visual indicator includes at least one of a light emitting diode and an incandescent light.

16. The system of claim 1, wherein the low fluid sensor includes at least one of a low fluid level sensor and a low fluid pressure sensor.

17. The system of claim 1, further comprising a capacitor and a diode that filters a signal from the ignition coil.

18. The system of claim 1, further comprising an emergency switch.

19. The system of claim 18, wherein the emergency switch is operable to shut off the engine and to enable the audible indicator.

20. The system of claim 18, wherein the emergency switch enables a transmitter.

21. A method of indicating a low fluid condition in an engine, the engine having an ignition coil, the method comprising:

changing a condition of a low fluid sensor in response to a low fluid condition;

enabling a visual indicator during engine starting in response to a start switch and the condition of the low fluid sensor;

disabling an audible indicator during engine starting in response to the start switch and the condition of the low fluid sensor; and activating the audible indicator in response to the condition of the low fluid sensor after the engine has started.

22. The method of claim 21, wherein enabling the visual indicator includes powering the visual indicator with a battery.

23. The method of claim 21, wherein disabling the audible indicator includes delaying the activation of an enable switch.

24. The method of claim 22, wherein the enable switch includes at least one of a transistor and an output of a controller.

25. The method of claim 21, wherein activating the audible indicator includes at least one of switching the state of a transistor and an output of a controller.

26. The method of claim 21, wherein said low fluid sensor changes its condition in response to a low oil pressure.

* * * * *